US005437503A

United States Patent [19]

Baker et al.

[11] Patent Number: 5,437,503

[45] Date of Patent: Aug. 1, 1995

[54] MODULAR STORAGE DRAWER ASSEMBLY FOR USE IN A REFRIGERATOR

[75] Inventors: Phillip D. Baker, Morganton, N.C.; Claude L. Blake, Lanesville, Ind.

[73] Assignee: General Electric Company, Louisville, Ky.

[21] Appl. No.: 69,602

[22] Filed: Jun. 1, 1993

[51] Int. Cl.[6] ..... A47B 96/00; F25D 25/00

[52] U.S. Cl. ..... 312/404; 312/348.4; 62/382

[58] Field of Search ..... 312/404, 401, 402, 348.4; 62/382

[56] References Cited

U.S. PATENT DOCUMENTS

| | | | |
|---|---|---|---|
| 2,297,859 | 10/1942 | Anderson | 62/382 X |
| 2,317,212 | 4/1943 | Newman | 220/35 |
| 2,331,560 | 10/1943 | Maniscalco | 312/404 X |
| 2,709,900 | 6/1955 | Zearfoss, Jr. | 62/103 |
| 3,937,537 | 2/1976 | Dietterich | 312/404 X |
| 4,013,434 | 5/1977 | Kronenberger et al. | 62/382 |
| 4,557,118 | 12/1985 | Pink | 62/382 |
| 4,745,775 | 5/1988 | Bussan | 62/382 |
| 5,040,856 | 8/1991 | Wilkins | 312/402 |
| 5,181,772 | 1/1993 | Albiez | 312/348 |

*Primary Examiner*—Kenneth J. Dorner
*Assistant Examiner*—David E. Allred
*Attorney, Agent, or Firm*—H. Neil Houser

[57] ABSTRACT

A modular storage drawer assembly includes a molded drawer having bottom, side and rear walls and a front wall which is only partly as high as the side walls. A molded front module includes a rectangular frame. The drawer and frame include mating projections and openings to attach the frame to the drawer. The frame has a central opening and a panel is positioned over the opening. The frame and panel have interfitting edges and the panel includes a rib which protects the junction between the edges. The panel includes ventilation openings and a slide control member is mounted to selectively expose or close the openings.

14 Claims, 2 Drawing Sheets

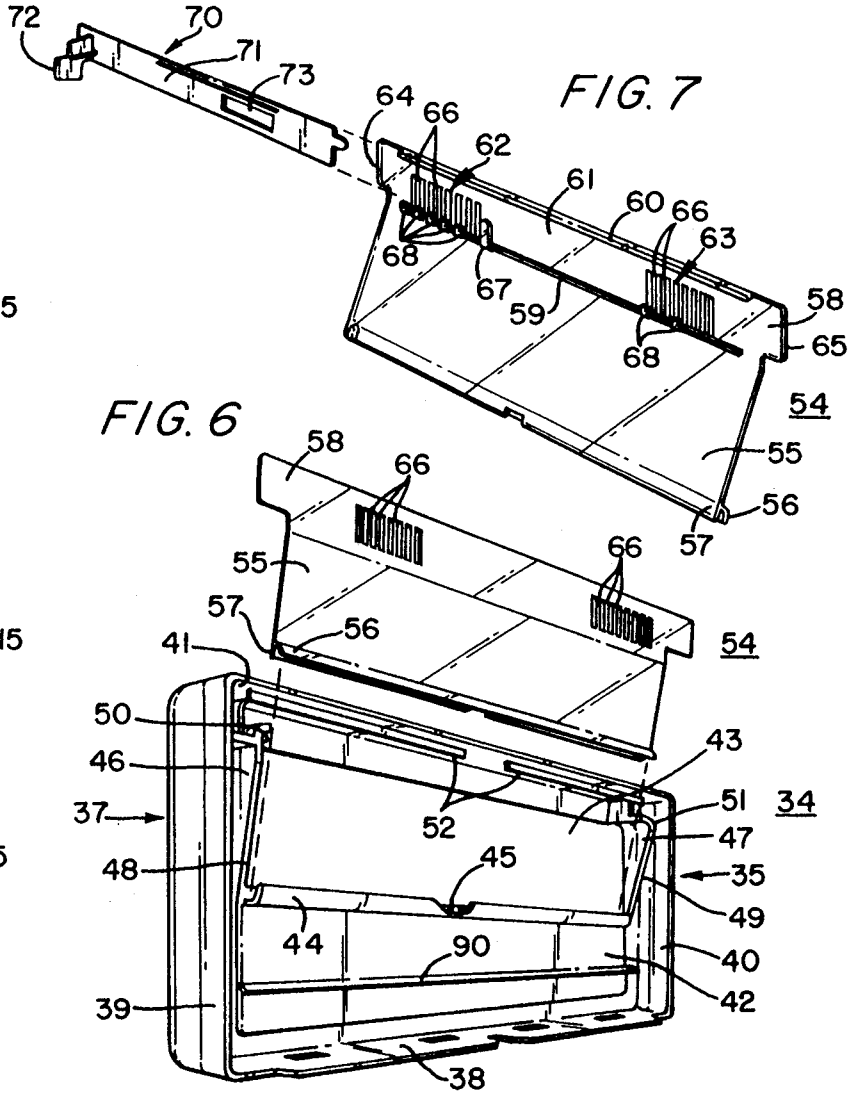
FIG. 7
FIG. 6
54
34
58
65
55
56
57
63
66
60
68
61
59
62
67
64
73
71
70
72
43
51
47
35
49
40
42
45
90
38
52
44
41
50
46
37
48
39
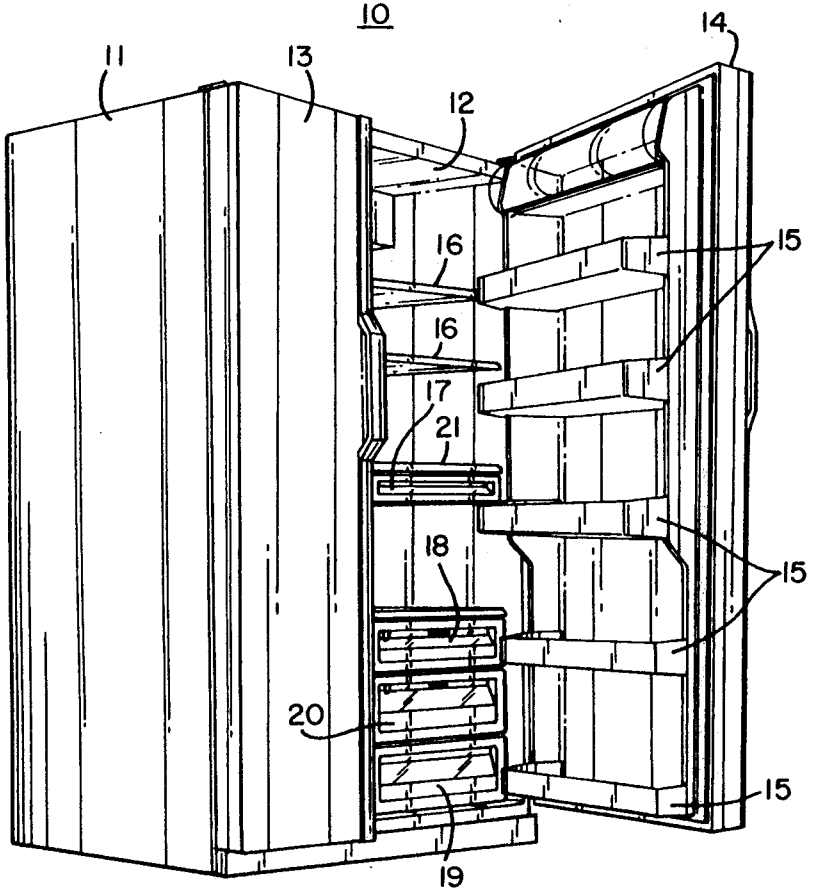
FIG. 1
10
11
12
13
14
15
16
17
18
19
20
21

MODULAR STORAGE DRAWER ASSEMBLY FOR USE IN A REFRIGERATOR

BACKGROUND OF THE INVENTION

Refrigerators, including refrigerator/freezer type refrigerators, employ drawers of various sizes to perform different functions. For example, the flow of air between some drawers and the remainder of the refrigerated compartment is controlled to maintain a higher humidity environment in those drawers. Some drawers include adjustable vent control arrangements so the user can modify the amount of air flowing through that drawer. Other drawers have no such vent control. Many consumers desire to be able to select between refrigerators with different interiors, including different color schemes, to better match their particular desires. The front of drawers are a commonly used tool for achieving such differentiation. All of these and other differentiation requirements multiply the number of different drawer constructions needed by an individual manufacturer. Numerous designs have been incorporated into refrigerator drawer assemblies to address one or more of the demands; however, none of them have been optimal in satisfying all the different requirements.

It is an object of the present invention to provide an improved drawer assembly for use with refrigerators which is easy and sure in assembly while providing flexibility to satisfy various needs.

It is another object of this invention to provide such an improved drawer assembly which reduces the inventory of parts or sub-assemblies required to provide various drawer assemblies with different uses and appearances.

SUMMARY OF THE INVENTION

In accordance with one embodiment of the invention a drawer assembly for use in a refrigerated compartment includes a molded drawer body with a bottom wall, side walls, a rear wall and a front wall which projects upwardly only a portion of the height of the side walls. A molded drawer front module includes a rectilinear frame, with the drawer body and frame including cooperating projections and openings to mount the frame to the front of the body. The frame defines a rectilinear opening and includes a lower wall with a top edge forming the bottom of the opening. A panel is positioned over the opening and includes a bottom edge which interfits with the top edge of the frame lower wall. The panel also includes a rib which protects the junction of the lower wall and panel. The upper portion of the panel is joined to the frame.

The panel includes a pair of spaced apart horizontally extending ledges which define a channel therebetween. A pair of ventilation openings are formed in the channel in spaced apart relationship and an elongated control member is mounted in the channel. The control member is horizontally moveable within the channel between a position covering the ventilation openings and a position exposing the ventilation openings.

BRIEF DESCRIPTION OF THE DRAWINGS

FIG. 1 is a perspective view of a refrigerator with the fresh food compartment door open to illustrate drawers incorporating certain embodiments of the present invention;

FIG. 6 is an exploded view of the front module of the drawer illustrated in FIG. 2;

FIG. 7 is an exploded view of the panel and control member of the front module illustrated in FIG. 6.

DETAILED DESCRIPTION OF PREFERRED EMBODIMENT

Figure 3:
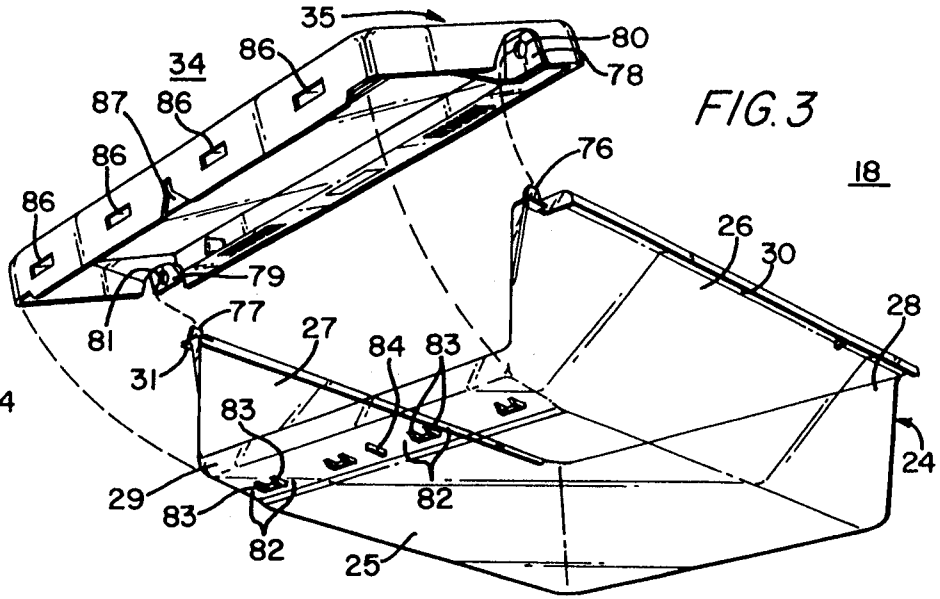
FIG. 3 is an exploded view of the drawer assembly of FIG. 2, with the drawer front module removed from the drawer body.
Figure 2:
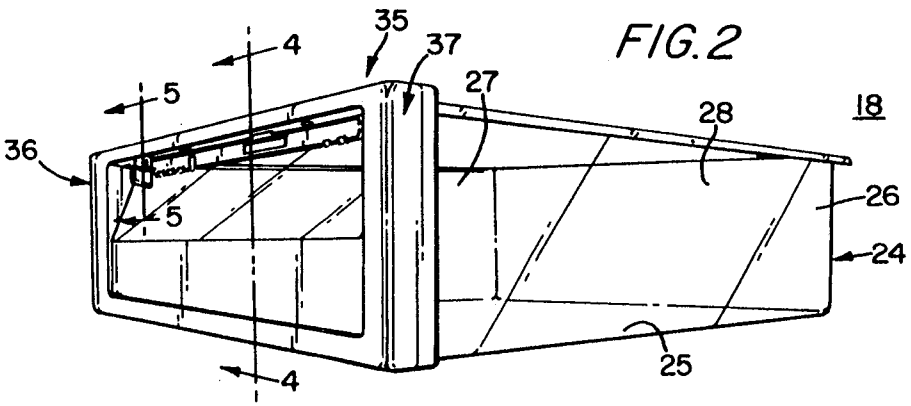
FIG. 2 is a perspective view of a drawer assembly incorporating one embodiment of the present invention.

Referring now to the drawings and particularly to FIG. 1, there is shown a side-by-side refrigerator/-freezer type of refrigerator 10 having an outer cabinet 11 containing a freezer compartment (not shown) and a fresh food compartment 12 separated by an internal wall. Access to the freezer and to the fresh food compartments is provided by freezer door 13 and fresh food door 14 respectively. Conveniently a number of movable shelves or bins 15 are mounted on the inside of the door 14 and movable shelves 16 are mounted inside the compartment 12. Also one or more storage drawers, such as 17, 18, 19 and 20, are mounted in compartment 12 to store selected items. Generally each of these drawer assemblies includes a solid shelf which functions to close the top of the drawer and to provide a surface for storing additional items. Depending upon the intended use of the drawer it may fit loosely under the shelf so that air can flow into the drawer or it can be tightly sealed against the under side of the shelf to restrict air flow and thus control the atmosphere in that drawer.

For example, drawer 17 seals tightly against a shelf 21 when it is closed to provide an essentially air tight space within the drawer. Drawer 17 is relatively short so that its volume is relatively small and it conveniently may be used to store snacks and similar items. Shelves 18–20 are deeper or taller than shelf 17 and serve to store more bulky items. As will be explained in more detail herein after shelves 18 and 20 have mechanisms to control the amount of air flow through the front of the drawer. As is well known in the art, such drawers are mounted so that air flow is possible between the top of the drawer and the shelf above it so that control of air flow through the drawer may be controlled by controlling the air flow at the front of the drawer. This permits the user to maintain a higher humidity within drawers 18 and 20 than is generally present in the fresh food compartment. For example, drawer 18 may be shorter than either 19 or 20 and conveniently may be used to store fruits. Drawer 20 may be taller than drawer 18 and conveniently may be used to store vegetables. Bottom drawer 19 is of a larger size, like drawer 20, but does not include a mechanism to control air flow at the front of the drawer. Thus the user cannot control the humidity within drawer 19 and it conveniently would be used to store meats as the coldest air in a fresh food compartment is at the bottom. It will be understood that the drawers may have other arrangements and relative sizes.

It will be seen from the foregoing that a number of different drawer constructions are normally included in a refrigerator. Individual consumers often prefer different mixes of such drawers and prefer different color schemes. Thus manufacturers are faced with the challenge of providing a multitude of drawer assemblies in an economic manner. Referring to FIGS. 2–8 there are illustrated improved drawer assemblies which solve these and related problems. FIGS. 2–7 illustrate a drawer assembly for drawers such as 18 (or 20) for example. The drawer assembly 18 includes a body 24 having a bottom wall 25, upstanding side walls 26 and 27, an upstanding rear wall 28 and a front wall 29. The front wall 29 joins the side walls but extends or projects upwardly from the bottom wall only part of the height of the side walls so that the front of the drawer body is open. Outwardly extending lips 30 and 31 are formed along the upper edges of the side walls 26, 27 respectively and are used to mount the drawer assembly in the refrigerator. Typically the lips cooperate with rollers or slides mounted adjacent the side walls of the refrigerated compartment. However, as the details of mounting the drawers in the refrigerator are not an integral part of the present invention, they have been omitted for the sake of simplicity.

A drawer front module 34 closes the front of the drawer assembly. The front module includes a generally rectilinear frame 35 including a rectangular rim of right angled cross section with a planar front 36 and rearwardly projecting side 37. The side 37 includes a bottom wall 38, side walls 39 and 40 and a top wall 41. Similarly the front 36 includes corresponding bottom, side and top portions. A generally vertical lower wall 42 extends between the side walls 39, 40 and stops well below the top wall 41 so that an opening 43 is formed in the center of the frame 34. The upper edge of the lower wall 42 defines the lower edge of opening 43 and is formed with an U-shaped cross-section having an inner lip 44 and an outer lip 45. The frame 34 also includes a pair of inner side wall 46 and 47 which extend upwardly from the ends of the lower wall 42 to define the side edges of opening 43. The inner edge of the side walls 46–47 include lower portions 48, 49 which are slightly inclined to the vertical and upper portions 50, 51 which are substantially vertical. An interrupted ledge 52 extends across and depends from top wall 41 slightly above the upper portions 50–51.

A panel 54 to substantially close the opening 43 includes a lower portion 55 which is inclined slightly to the vertical, to correspond to lower portions 48–49 of the side walls 46–47 respectively. The lower edge of lower portion 55 is formed with a downwardly facing U-shape having an inner lip 56 and an outer lip 57. The panel 54 also includes an upper portion 58 which is generally vertical, corresponding to upper portions 50–51 of inner walls 46–47 respectively. The outer surface of upper portion 58 has a lower ledge 59 and an upper ledge 60 which extend horizontally substantially across the panel in vertically spaced apart relationship. The panel is mounted to the frame by interfitting the lips 44–45 of lower wall 42 with lips 56–57 of panel 54. Preferably the lips are interlaced so that inner lip 56 is toward the inside of drawer body 24 relative to inner lip 44. Then the upper portion of panel is permanently connected to the frame 35. Preferably this may be accomplished by sonic welding upper panel ledge 60 to depending frame ledge 52.

Figure 5:
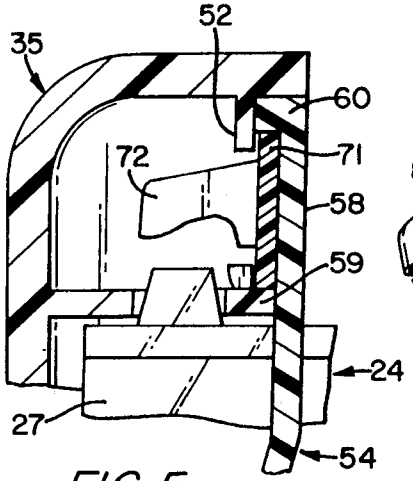
FIG. 5 is a fragmentary cross section view as seen along line 5—5 in FIG. 2.

Referring particularly to FIG. 7, the panel ledges 59–60 define a channel 61 which extends horizontally across the panel. A first ventilation opening 62 is formed in the channel adjacent a first side edge 64 of the panel and a second ventilation opening is formed in the channel toward a second side edge 65 of the panel. The openings are illustrated as including a number of vertically extending bars 66 to protect the inside of the drawer when the openings are exposed; however, it will be recognized that clear openings may be provided if desired. A number of tabs 68 project upwardly from the lower ledge 59 and are spaced outwardly of the upper panel portion 58. A larger tab or stop 67 projects upwardly from the ledge 59 in spaced relationship to upper portion 58 and inwardly of the opening 62. An elongated control member 70 includes an elongated strip 71 with a control handle 72 adjacent a first end and a control opening 73 remote from the first end. The strip 71 is inserted into the channel 61 between the upper end 58 of panel 54 and the tabs 68 before the panel is mounted to the frame 35. When the panel is then connected to the frame, the ledges 52 and 60 come into register. As best seen in FIG. 5, frame ledge 52 overlaps and extends below panel ledge 60. Thus ledge 52 constrains the upper edge of strip 71 so that the control member is mounted for sliding movement within channel 61. The control member has a first extreme or terminal position in which the handle 72 is adjacent the first panel edge 64 and a second terminal position in which the handle 72 is against stop 67. When control member 70 is in its first position, the portion of strip 71 between the handle and control opening 73 covers ventilation opening 62 and the portion of strip 71 on the other side of control opening 73 from handle 72 covers ventilation opening 63. On the other hand, when control member is in its second terminal position, with handle 72 against stop 67, the strip 71 is to the right of ventilation opening 62 (as seen in FIG. 7) and control opening 73 is in register with ventilation opening 63 so that air can flow through panel 54 between the interior of the drawer assembly and the remainder of the refrigerator.

Figure 4:
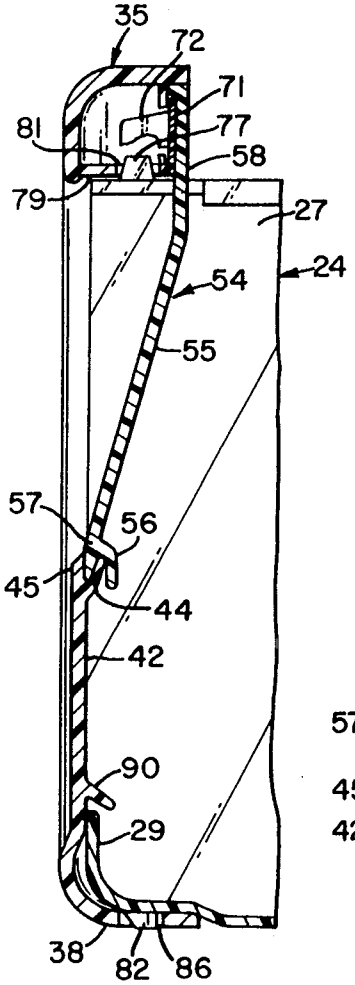
FIG. 4 is a cross section view as taken along line 4—4 in FIG. 2.

Referring now particularly to FIGS. 3 and 4, the upper front corners of drawer side walls 26, 27 include upwardly projecting lugs 76 and 77 respectively. The frame 34 includes ledges 78 and 79 adjacent its upper corners which have openings 80 and 81 respectively to receive the lugs 76, 77 respectively. The front portion of drawer body bottom wall 25 includes a number of small downwardly extending U-shaped projections 82, formed with ramp like arms 83, and a longer centrally positioned projection 84. The bottom wall 38 of frame 34 includes a number of rectangular openings 86 positioned to receive the projections 82 and a general V-shaped central opening to receive the elongated projection 84. The frame 34 is mounted to the drawer body by engaging the lugs 76, 77 in the openings 80, 81 and then rotating the frame relative to the body until the projections 82 and 84 are fully seated in the openings 86 and 87 respectively. The elongated projection 84 and V-shaped opening 87 positively guide the frame and body as their lower portions come together to assure that the projections and openings meet properly. The individual arms 83 of each projection 82 are small, which simplifies molding. At the same time, the arms of each projection 82 form a cooperating pair, which provides a strong connection between the drawer body and frame.

The assembled drawer is illustrated in FIG. 4. It will be seen that the lower frame wall 42 extends well above the top of body front wall 29. A rib 90 extends across wall 42 just above the upper edge of wall 29. The rib projects inwardly and downwardly to overlie and protect the upper end of wall 29. Similarly it will be seen that the inner lip 56 of panel 54 overlaps lip 44 of lower wall 42 so as to protect the junction between the lower wall and panel. Often fresh vegetables may be wet when placed in a refrigerator drawer and from time to time meat products leak blood. The construction just described protects the junction between the drawer body and frame and the junction between the frame lower wall and the panel from accumulating any such liquid, which then would be difficult to clean. The slanting of the lower portion 55 of panel 54 will provide visual access to the inside of the drawer while the vertical positioning of upper wall portion 57 and the control member 70 helps assure good operation while at least to some degree concealing the mechanism from view.

Drawer 19 is similar to drawers 18 and 20 except that there is no provision to adjust the air flow through the drawer frame. To that end the construction is the same as previously described except that the panel is solid and the control member is omitted.

Figure 8:
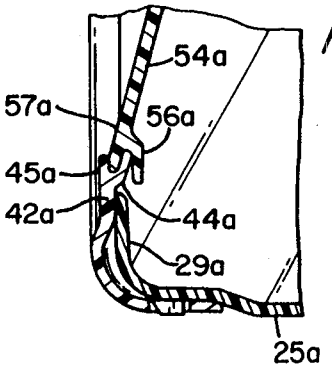
FIG. 8 is a fragmentary cross section view illustrating the lower front portion of a drawer incorporating another embodiment of the present invention.

Shorter drawers, such as 17, may include or omit the air adjustment feature. However, as the drawer gets shorter, the lower wall of the frame becomes shorter and FIG. 8 illustrates such a drawer. In FIG. 8 like numerals, with the subscript a, have been used to identify corresponding parts. It will be seen that frame lower wall 42*a* extends to just above the upper edge of drawer body front wall 29*a*. The inner lip 56*a* of panel 54*a* protects both the junction of lower wall 42*a* and panel 54*a* and the junction of lower wall 42*a* and front wall 29*a*. Thus there is no rib corresponding to rib 90 in FIG. 4.

What is claimed is:

1. A storage drawer assembly for use in a refrigerated compartment, said assembly including:

an integrally molded drawer body formed with a bottom wall, a pair of spaced apart side walls, a rear wall and a front wall, said front wall extending between said side walls and projecting upwardly from said bottom wall only a portion of the height of said side walls and including a top edge;

a molded drawer front module including a rectilinear frame, said frame and said drawer body including cooperating means latching said module in position across the front of said body;

said frame defining a generally rectilinear opening having a bottom, top and sides, said frame including a vertically disposed, generally planar lower wall with a top edge forming the bottom of the opening and positioned higher than said top edge of said drawer body front wall;

said module also including a panel positioned over the frame opening in said front flange and including a bottom edge having an interfitting junction with said top edge of said lower wall, said panel including a first elongated rib extending horizontally across said panel proximate said panel bottom edge and projecting inwardly and downwardly of said panel within said drawer body to overlap said top edge of said frame lower wall for protecting said junction of said lower wall and said panel;

said panel including a top portion permanently attached to said frame adjacent the top of said opening to form an unitary structure.

2. A storage drawer assembly as set forth in claim 1, wherein:

a second elongated rib extends horizontally across said frame lower wall and projects inwardly and downwardly of said front module to protect said top edge of said drawer body front wall.

3. A storage drawer assembly as set forth in claim 1, wherein:

said junction of said panel bottom edge and said top edge of said lower wall is positioned adjacent said top edge of said drawer body front wall and said first rib protects said top edge of said front wall.

4. A storage drawer assembly as set forth in claim 1, wherein: said panel defines at least one ventilation opening and a control member is slidably mounted on said panel for selective exposure of said at least one ventilation opening.

5. A storage drawer assembly as set forth in claim 1, wherein:

a lower ledge and an upper ledge extend generally horizontally across said panel in spaced relationship and define a channel therebetween;

at least one ventilation opening is formed in said panel within said channel;

an elongated control member is slidably mounted in said channel for selective exposure of said at least one ventilation opening.

6. A storage drawer assembly as set forth in claim 5, wherein:

said control member includes an upper portion and a lower portion;

means projects upwardly from said lower ledge in spaced relationship to said panel to slidably secure said lower portion of said control member in said channel; and said drawer module frame includes a ledge engaging said panel upper ledge and extending horizontally across said panel below said panel upper ledge to slidably secure said upper portion of said control member in said channel.

7. A storage drawer assembly as set forth in claim 6, wherein:

said permanent attachment of said top portion of said panel to said frame consists of a sonic weld between said upper ledge of said panel and said ledge of said frame.

8. A storage drawer assembly for use in a refrigerated compartment, said assembly including:

an integrally molded drawer body with a bottom wall including a front section, a pair of side walls, each of said side walls having an upper front corner, a rear wall and a front wall, said front wall extending between said side walls, projecting upward from said bottom wall and having a top edge positioned only part way up said side wall; said body including a plurality of horizontally spaced apart protrusions projecting downwardly proximate said front section of said bottom wall, said body also including a lug projecting upward proximate said upper front corner of each side wall;

a molded drawer front module including a rectilinear frame including an upper support structure having a pair of spaced apart mounting openings, said frame also including a bottom wall with a plurality of horizontally spaced apart mounting openings; each of said lugs being received in a corresponding one of said mounting openings in said upper support structure and each of said protrusions being received in a corresponding one of said mounting openings in said bottom wall of said frame to secure said drawer body and front module together;

said frame defining a generally rectilinear opening having a bottom, top and sides, said frame including a vertically disposed, generally planar lower wall with a top edge forming said bottom of said rectilinear opening and positioned above said top edge of said front wall of said drawer body;

said module also including a panel positioned over the rectilinear opening and including a bottom edge having an interfitting junction with said top edge of said lower wall, said panel bottom edge including a first elongated rib extending horizontally across said panel and projecting inwardly and downwardly of said panel within said drawer body to overlap said top edge of said frame lower wall for protecting said junction of said lower wall and said panel;

said panel including a top portion permanently attached to said frame to form an unitary structure.

9. A storage drawer assembly as set forth in claim 8, wherein:

a second elongated rib extends horizontally across said frame lower wall and projects inwardly and downwardly of said front module to protect said top edge of said drawer body front wall.

10. A storage drawer assembly as set forth in claim 8, wherein:

said junction of said panel bottom edge and said top edge of said lower wall is positioned adjacent said top edge of said drawer body front wall and said first rib protects said top edge of said front wall.

11. A storage drawer assembly as set forth in claim 8, wherein:

said panel defines at least one ventilation opening and a control member is slidably mounted on said panel for selective exposure of said at least one ventilation opening.

12. A storage drawer assembly as set forth in claim 8, wherein:

a lower ledge and an upper ledge extend generally horizontally across said panel in spaced relationship and define a channel therebetween;

at least one ventilation opening is formed in said panel within said channel;

an elongated control member is slidably mounted in said channel for selective exposure of said at least one ventilation opening.

13. A storage drawer assembly as set forth in claim 8, wherein:

said control member includes an upper portion and a lower portion;

means projects upwardly from said lower ledge in spaced relationship to said panel to slidably secure said lower portion of said control member in said channel; and said drawer module frame includes a ledge engaging said panel upper ledge and extending horizontally across said panel below said panel upper ledge to slidably secure said upper portion of said control member in said channel.

14. A storage drawer assembly as set forth in claim 8, wherein:

said permanent attachment of said top portion of said panel to said frame consists of a sonic weld between said upper ledge of said panel and said ledge of said frame.

* * * * *